US011882968B2

(12) United States Patent
Wanninger et al.

(10) Patent No.: US 11,882,968 B2
(45) Date of Patent: Jan. 30, 2024

(54) DISPENSER COMPRISING A REPLACEABLE LIQUID CONTAINER

(71) Applicant: Essity Hygiene and Health Aktiebolag, Gothenburg (SE)

(72) Inventors: Dan Wanninger, Philadelphia, PA (US); Erol Searfoss, Philadelphia, PA (US); Peter Bergman, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 18/009,733

(22) PCT Filed: Jul. 2, 2020

(86) PCT No.: PCT/EP2020/068637
§ 371 (c)(1),
(2) Date: Dec. 11, 2022

(87) PCT Pub. No.: WO2022/002402
PCT Pub. Date: Jan. 6, 2022

(65) Prior Publication Data
US 2023/0240480 A1 Aug. 3, 2023

(51) Int. Cl.
*A47K 5/12* (2006.01)

(52) U.S. Cl.
CPC ..... *A47K 5/1207* (2013.01); *A47K 5/1217* (2013.01)

(58) Field of Classification Search
CPC ... A47K 5/1207; A47K 5/1209; A47K 5/1217
(Continued)

(56) References Cited

U.S. PATENT DOCUMENTS 5,625,659 A * 4/1997 Sears ..... G01F 15/00 377/21
6,375,038 B1 4/2002 Daansen et al.
(Continued)

FOREIGN PATENT DOCUMENTS

CN 2490103 Y 5/2002
CN 102858215 A 1/2013
(Continued)

OTHER PUBLICATIONS

International Search Report & Written Opinion for International Application No. PCT/EP2020/068637; International Filing Date: Jul. 2, 202; dated Mar. 5, 2021; 9 pages.
(Continued)

*Primary Examiner* — Lien M Ngo
(74) *Attorney, Agent, or Firm* — CANTOR COLBURN LLP

(57) ABSTRACT

The present disclosure relates to a dispenser system comprising a dispenser and a replaceable liquid container, and a dispensing mechanism causing fluid to be discharged from the liquid container upon actuation and comprising a pump unit for discharging said liquid; said dispenser also comprising a detection unit for detecting displacement of said pump unit; and wherein information related to said displacement can be transmitted to an external computer unit. The pump unit is configured with a displaceable element which, upon actuation, has a linear motion during discharging of liquid, that the displaceable element interacts with a rotating gear element, and that the gear element is associated with a sensor of the magnetometer type.

17 Claims, 9 Drawing Sheets

(58) Field of Classification Search
USPC ..... 222/183, 181.1, 181.2, 52, 63, 181.3, 222/182, 207
See application file for complete search history.

(56) References Cited

U.S. PATENT DOCUMENTS

| | | | | |
|---|---|---|---|---|
| 7,757,567 | B2 | 7/2010 | Joyce et al. | |
| 7,783,380 | B2 | 8/2010 | York et al. | |
| 8,091,735 | B2 | 1/2012 | Girard et al. | |
| 8,201,707 | B2 | 6/2012 | Ophardt | |
| 8,261,942 | B2 * | 9/2012 | Chen | A47K 5/1209 700/282 |
| 8,783,511 | B2 | 7/2014 | Snodgrass | |
| 8,905,265 | B2 * | 12/2014 | Muderlak | A47K 5/1207 222/38 |
| 8,991,649 | B2 | 3/2015 | Wegelin et al. | |
| 9,443,357 | B2 | 9/2016 | Archer et al. | |
| 9,580,210 | B2 | 2/2017 | Wegelin et al. | |
| 9,993,120 | B2 * | 6/2018 | Xie | F04B 17/03 |
| 10,057,709 | B2 | 8/2018 | Wegelin et al. | |
| 10,365,139 | B2 | 7/2019 | Singh et al. | |
| 10,460,549 | B2 | 10/2019 | Wegelin | |
| 10,464,091 | B2 | 11/2019 | Ophardt | |
| 10,614,699 | B2 | 4/2020 | Wegelin et al. | |
| 10,723,541 | B2 | 7/2020 | Akdogan et al. | |
| 10,929,794 | B2 | 2/2021 | Ghazi | |
| 10,996,690 | B2 | 5/2021 | Carlson | |
| 11,118,955 | B2 | 9/2021 | Wegelin | |
| 11,123,153 | B2 | 9/2021 | Davis et al. | |
| 11,131,575 | B2 | 9/2021 | Moore | |
| 11,181,413 | B2 | 11/2021 | Kobs | |
| 11,257,350 | B2 | 2/2022 | Liu et al. | |
| 11,259,671 | B2 | 3/2022 | Wegelin et al. | |
| 11,272,815 | B2 | 3/2022 | Rospierski et al. | |
| 11,295,271 | B2 | 4/2022 | Williams et al. | |
| 11,299,386 | B2 | 4/2022 | Slater et al. | |
| 2009/0195385 | A1 | 8/2009 | Huang et al. | |
| 2011/0108410 | A1 * | 5/2011 | Ophardt | A47K 5/1217 204/157.44 |
| 2012/0245729 | A1 | 9/2012 | Wegelin et al. | |
| 2013/0020351 | A1 | 1/2013 | Pelfrey | |
| 2013/0282172 | A1 | 10/2013 | Chen | |
| 2015/0102056 | A1 | 4/2015 | Sage-Passant | |
| 2015/0223646 | A1 | 8/2015 | Wegelin et al. | |
| 2017/0136479 | A1 | 5/2017 | Ophardt et al. | |
| 2018/0199765 | A1 | 7/2018 | Wegelin et al. | |
| 2019/0063980 | A1 | 2/2019 | Kobs | |
| 2019/0254488 | A1 | 8/2019 | Tramontina | |
| 2020/0327520 | A1 | 10/2020 | Dyer | |
| 2021/0023577 | A1 | 1/2021 | Longarte Cifrián et al. | |
| 2021/0186274 | A1 | 6/2021 | Mechenbier et al. | |
| 2021/0401239 | A1 | 12/2021 | Buell et al. | |

FOREIGN PATENT DOCUMENTS

| | | | |
|---|---|---|---|
| CN | 109091048 | A | 12/2018 |
| CN | 109890513 | A | 6/2019 |
| DE | 102018116204 | A1 | 1/2020 |
| EP | 3061374 | A1 | 8/2016 |
| EP | 3231339 | B1 | 10/2017 |
| EP | 3241470 | A1 | 11/2017 |
| GB | 2087839 | | 6/1982 |
| WO | WO 2006/102262 | A2 * | 9/2006 |
| WO | WO 2006/102263 | A2 * | 9/2006 |
| WO | 2011133085 | A1 | 10/2011 |
| WO | WO 2017/070401 | A1 * | 4/2017 |
| WO | 2017188816 | A1 | 11/2017 |
| WO | WO 2018/080545 | A1 * | 5/2018 |
| WO | 2018224520 | A1 | 12/2018 |
| WO | 202071998 | A1 | 4/2020 |
| WO | 202138247 | A1 | 3/2021 |

OTHER PUBLICATIONS

International Preliminary Report on Patentability for International Application No. PCT/EP2020/068637; International Filing Date: Jul. 2, 202; dated Oct. 10, 2022; 18 pages.
Chinese Application No. 202080101597.2; Chinese Office Action with English translation dated Mar. 15, 2023; 11 pages.
International Preliminary Report on Patentability for International Application No. PCT/EP2020/068636; International Filing Date: Jul. 2, 2020; dated Sep. 30, 2022; 20 pages.
International Search Report & Written Opinion for International Application No. PCT/EP2020/068634; International Filing Date: Jul. 2, 2020; dated Mar. 3, 2021; 154 pages.
International Search Report & Written Opinion for International Application No. PCT/EP2020/068636; International Filing Date: Jul. 2, 2020; dated Mar. 4, 2021; 11 pages.

* cited by examiner

DISPENSER COMPRISING A REPLACEABLE LIQUID CONTAINER

CROSS REFERENCE TO RELATED APPLICATIONS

This application is a National Stage application of PCT/EP2020/068637, filed Jul. 2, 2020, which is incorporated by reference in its entirety herein.

TECHNICAL FIELD

The disclosure relates to dispensers and related systems, and more specifically to dispensers and related systems for selectively dispensing liquid from a replaceable liquid container.

BACKGROUND

Dispensers for liquids such as soap and similar hygiene products are well known. The general purpose of such dispensers is to contain and dispense various types of liquid. Today's dispensers are used in homes, offices, hospitals, restaurants, airports and other types of environments. Furthermore, such dispensers may be arranged for dispensing different types of liquids such as soap, sanitizers, lotions, shampoo, skin care products or other types of liquids.

Furthermore, dispenser systems of the type that include a dispenser and a replaceable liquid container are widely used. The use of a replaceable liquid container, for example for soap, allows users to replace an empty container with a new and full container in a simple manner.

A liquid dispenser system may comprise a dispenser with a housing which accommodates such a replaceable liquid container, which is also referred to as a "refill unit", or "refill cartridge". Such a liquid container is configured to be positioned inside a housing of the dispenser during use thereof. As the fluid is discharged from the liquid container, the remaining amount of fluid will gradually decrease. Eventually, the liquid container needs to be removed and replaced with a new one.

Furthermore, it is known to incorporate a pump unit, for example a foam pump unit, either in the replaceable liquid container or in the actual dispenser housing. Such a foam pump unit is previously known as such and is configured to transfer a liquid, such as for example soap, from the liquid container and discharge it out of the dispenser in the form of a foam. Other types of pump units exist, for example for discharging a liquid in the form of a spray.

Soap dispensers are known having a replaceable liquid container with an integrated foam pump. Such dispensers have certain advantages. For example, they provide a more hygienic solution than other systems, due to the fact that the liquid container is sealed. Another advantage is that such type of system minimizes the likelihood of liquid leaking during replacement of the replaceable liquid container and reduces the required number of moving parts in the dispenser. Furthermore, refilling can be made in a very simple manner by replacing an empty container with a full container.

Furthermore, a dispenser may be activated by a user by means of a suitable actuation device which can be either manual or automatic. A manual actuation device can for example be in the form of a push button or a lever which is arranged to activate a dispensing mechanism. Alternatively, an automatic actuation device can for example comprise a touch-free sensor device, such as an infrared sensor, which is configured to actuate an electric motor for operating a pump unit upon detection of the presence of a user.

Irrespective of which type of actuation device is used, the purpose of such a device is to allow a user to actuate the dispenser system so as to discharge a certain amount of the liquid (e.g., soap) which is contained inside the liquid container.

Furthermore, it may be required or desirable to detect the usage of a dispenser system, in particular with regard to the purpose of tracking the remaining contents of a replaceable liquid container. This is in order to determine when the liquid container is close to empty and for this reason should be replaced. It is of course desired that the container is used for as long as possible, i.e. it should not be replaced before it is empty, or close to empty.

To that end devices and methods have been provided to detect and analyze the consumption of soap in a replaceable liquid container. In particular, such systems can be provided with a detection unit for detecting the actual usage or alternatively the remaining volume of liquid in the container, and also for transmitting signals to an external computer unit and further to maintenance service staff, in order to send instructions to exchange the empty container for a new one.

One known system includes a manually operated fluid dispenser that is configured for estimating an amount of fluid discharged from a reservoir through of a pump unit. This is obtained by means of a potentiometer which forms part of an activation mechanism which also comprises a pivotally arranged lever which influences the electrical characteristics, suitably the electrical resistance, of the potentiometer. A change of the electrical characteristics of the potentiometer is monitored with time so that the amount of dispensed fluid can be determined. An indication of when the reservoir is empty can also be provided. That system also comprises a data communications unit which is arranged to transmit information wirelessly to a receiver via an antenna.

Even though the dispenser in the system described above tracks the usage of a liquid in a replaceable liquid container, there is a desire for further improvements within the field of technology in question. For example, there is a need to track the usage of a liquid container by means of more accurate measurements of the instant and cumulative consumption of liquid than is possible with known systems. Also, there is a need for detection units which can be integrated in a dispenser in a manner that is more cost-effective and more space-saving manner than in known systems.

Consequently, there is a need for further improvements within the technical field of liquid dispensers and related systems.

SUMMARY

In the present disclosure, a dispenser and related systems are provided that comprise a replaceable liquid container and which address the drawbacks discussed above.

In one embodiment, a dispenser system is provided that comprises a dispenser and a replaceable liquid container. The system also comprises a dispensing mechanism that causes fluid to be selectively discharged from the liquid container upon actuation. The dispensing mechanism comprises a pump unit for discharging said liquid. The dispenser comprises a detection unit for detecting displacement of said pump unit. Information related to said displacement can be transmitted to an external computer unit. The pump unit is configured with a displaceable element which, upon actuation, has a linear motion during discharging of liquid. The displaceable element interacts with a rotating gear element, and the gear element is associated with a sensor of the magnetometer type.

An advantage is provided through the fact that it will be possible to detect and track the actual usage of a replaceable liquid container by accurately detecting a cumulative consumption of liquid (e.g., soap) in said liquid container.

The sensor may comprise a rotating magnet on the gear element which cooperates with a fixed Hall effect sensor, in order to detect the rotational position of said gear element.

The detection unit may comprise an actuator which is pivotally displaced through movement of said displaceable element, said actuator having a geared section which meshes with said gear element.

The displaceable element may be configured for interacting with the gear element via a pivotally arranged and generally L-shaped actuator element having a geared section which meshes with said gear element.

The displaceable element may be configured for interacting with the gear element via a generally linear geared section which is arranged on the pump unit and which meshes with said gear element.

The sensor may comprise a 2-dimensional or 3-dimensional Hall effect sensor that measures the orthogonal magnetic fields in the rotational plane of said magnet, said sensor being configured so that when the magnet rotates during the actuation of the dispenser, the ratio of magnetic field strength among the measured dimensions changes and is used to determine the rotation angle of the magnet.

The dispenser may comprise an insert module which is configured to be removably positioned in said dispenser, said insert module being configured for accommodating said liquid container.

The detection unit may be arranged in said insert module.

The dispenser may comprise a transponder reader unit for cooperating with a transponder unit supported by said replaceable liquid container.

The transponder unit may be a radio frequency identification ("RFID") tag and the transponder reader unit may be an RFID reader unit.

The rotating gear element may be constituted by a gear wheel.

A method is also disclosed for operating a dispenser system comprising a dispenser and a replaceable liquid container, said method comprising: providing a pump unit for discharging liquid from the liquid container upon actuation of said dispenser system; detecting a displacement of said pump unit upon actuation; and transmitting information related to said displacement to an external computer unit. Furthermore, the method comprises: detecting a linear motion during discharging of liquid, upon actuation, of a displaceable element forming part of said pump unit; providing interaction of the displaceable element and a rotating gear element; and arranging the gear element so as to be associated with a sensor of the magnetometer type.

A rotational position of the gear element may be detected by means of a rotating magnet forming part of the sensor and provided on the gear element and cooperating with a fixed Hall effect sensor.

An actuator forming part of the detection unit may be pivotally displaced through movement of said displaceable element, said actuator having a geared section which meshes with said gear element.

Interaction of the displaceable element and the gear element may be allowed via a generally linear geared section which is arranged on the pump unit and which meshes with said gear element.

Cooperation may be provided between a transponder reader unit and a transponder unit supported by said replaceable liquid container.

Further advantages and advantageous features of the disclosure are disclosed in the following description.

In the following, the term "dispenser system" is used to indicate a combined apparatus comprising at least a dispenser and a liquid container. More precisely, as will be described below, the dispenser system is configured so that it may or may not include an insert module which as such is configured for accommodating the liquid container.

In the following, the term "replaceable liquid container" is used to indicate a container for a liquid such as for example soap and which is configured so as to be easily removed from the dispenser when it is empty, thereby allowing replacement with a new liquid container.

In the following, the term "transponder" is used to indicate an electronic device which is configured for receiving an incoming signal and for emitting a response signal in response to the incoming signal. A transponder can be either an active or passive RFID tag or some other form of transponder such as a tag or label based for example on Bluetooth® or biometric technology, or similar.

In the following, the term "transponder reader unit" is used to indicate an electronic device which is configured for cooperating with one or more transponders in a manner so that data stored on said transponders can be read.

In the following, the term "insert module" is used to describe a device which is intended to be used for removably mounting inside the housing of an existing dispenser with the purpose of allowing certain functions to be added to said existing dispenser. In particular, the insert module is configured for accommodating a replaceable liquid container. Additional functions and features can be added to the insert module, as will be described in detail below.

BRIEF DESCRIPTION OF THE FIGURES

The disclosure will be described in greater detail below with reference to the figures shown in the appended drawings.

DETAILED DESCRIPTION

Different aspects of the present disclosure will be described more fully hereinafter with reference to the enclosed drawings. The disclosure can be realized in many different forms and should not be construed as being limited to the embodiments described below.

Figure 1:
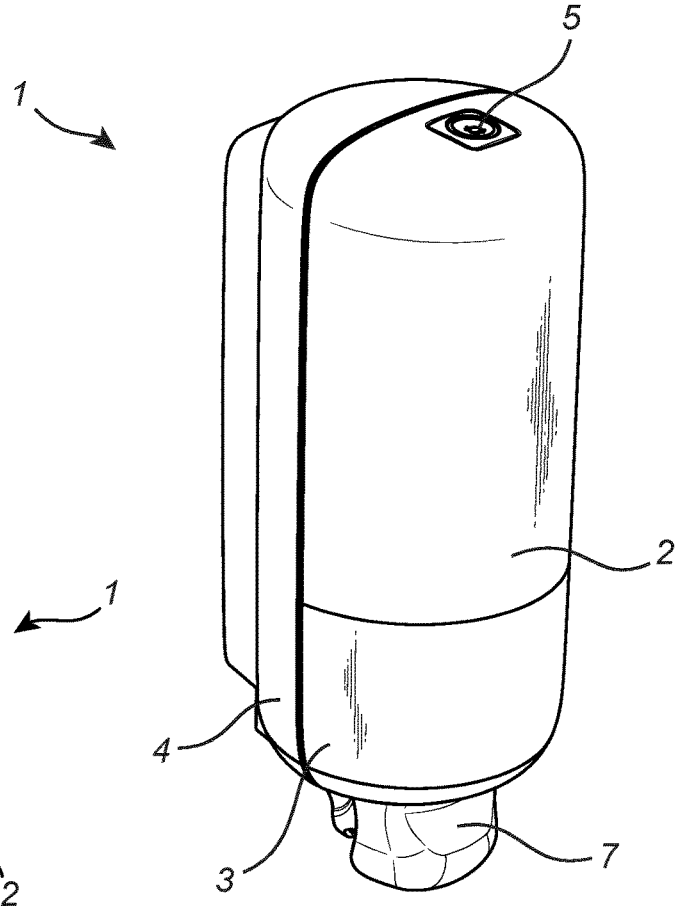
FIG. 1 shows a perspective view of a dispenser for liquids according to a first embodiment.

With initial reference to FIG. 1, there is shown a perspective view of a dispenser 1 for selectively dispensing a liquid such as soap, for example. The dispenser 1 can alternatively be used for other liquids such as a sanitizer, lotion, shampoo, skin care product, detergent, disinfectant, moisturizer, alcogel or a similar liquid, or alternatively fluids such as dispersions. According to what is known as such, the dispenser 1 is arranged so that the liquid can be discharged in the form of a fluid, a gel, a foam, a spray or similar. Generally, the dispenser 1 is arranged for being placed in a location where the liquid is intended to be used, e.g. a bathroom, a hospital room or a kitchen.

In an embodiment shown in the drawings, the dispenser 1 is used for dispensing soap which is discharged as foam. To this end, the dispenser 1 can be actuated by means of a foam pump unit which is not shown in FIGS. 1 and 2 but which will be described below.

Figure 2:
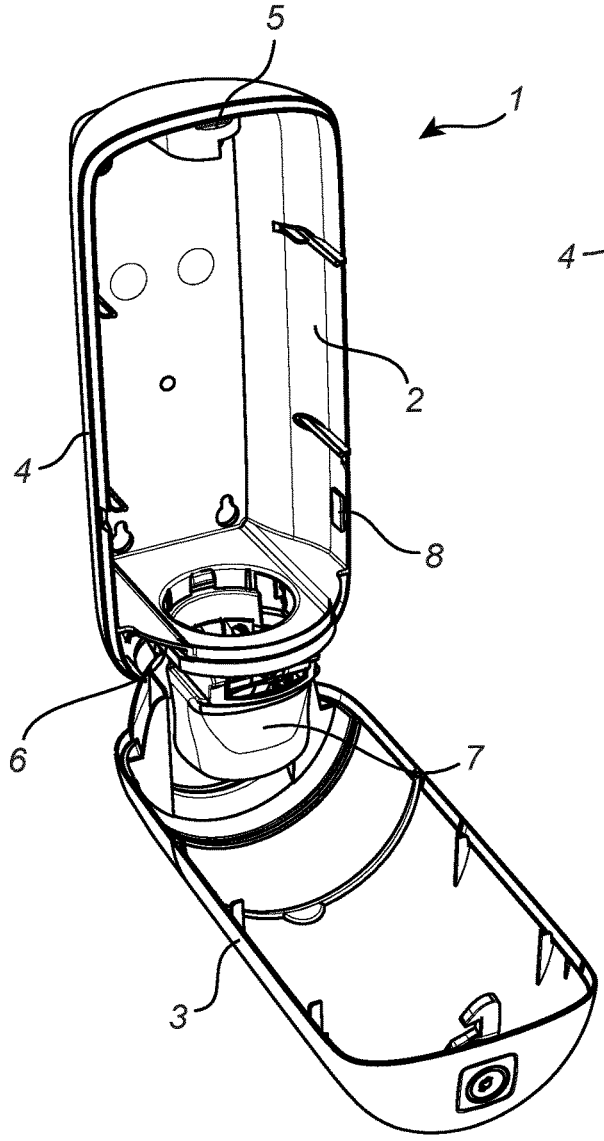
FIG. 2 shows a perspective view of the dispenser according to FIG. 1, in a condition in which a housing of the dispenser has been opened to allow access to the interior of the dispenser.

The dispenser 1 shown in FIGS. 1 and 2 comprises a housing 2 which is configured for containing a replaceable liquid container (not visible in FIGS. 1 and 2), also referred to as a replaceable refill unit. The housing 2 comprises a first portion 3 and a second portion 4 which are coupled to each other by a hinge and which can be locked together by means of a lock 5. Other fastening means between the first portion 3 and the second portion 4 are also contemplated. The first portion 3 corresponds to a front side of the housing 2 whereas the second portion 4 corresponds to a rear side of the housing 2 and is furthermore configured for mounting for example on a wall. The first portion 3 and the second portion 4 are suitably hinged to one another along the bottom of the housing 2.

This is clearly shown in FIG. 2, in which it can be seen that the first portion 3 is pivotally arranged in relation to the second portion 4 via a hinge mechanism 6 in the form of a pivot joint or a similar arrangement.

Other designs for opening the housing 2 are also possible within the scope of this disclosure. Furthermore, the housing 2 may be made of any suitable material or combination of materials that may for example include plastic and/or metal.

As mentioned initially, the dispenser 1 is provided with an actuation device 7. The embodiment shown in the drawings comprises an actuation device 7 in the form of a manual push button. A user who wishes to discharge an amount of soap will have to push the actuation device 7, which causes discharging a liquid in a manner which will be described below.

According to an embodiment which is not shown in the drawings, the dispenser 1 can alternatively be provided with an automatic actuation device, which may comprise a touch-free sensor unit which may be based for example on an infrared sensor unit. Actuation of the sensor may then cause an electric motor to be activated in order to operate the dispenser upon detection of the presence of a user.

Furthermore, the dispenser 1 is of the type which is provided with a transponder reader unit 8, i.e. an antenna unit or transponder detection unit which is configured to detect and cooperate with a transponder unit on a liquid container. The transponder unit will be described below with reference to FIG. 3. It should be noted that the disclosure is not limited to dispenser systems in which a dispenser 1 is provided with a transponder reader unit. In fact, as will be described below in detail, embodiments exist in which a transponder reader unit can be positioned on a separate insert module which is configured for accommodating a replaceable liquid container.

Figure 3:
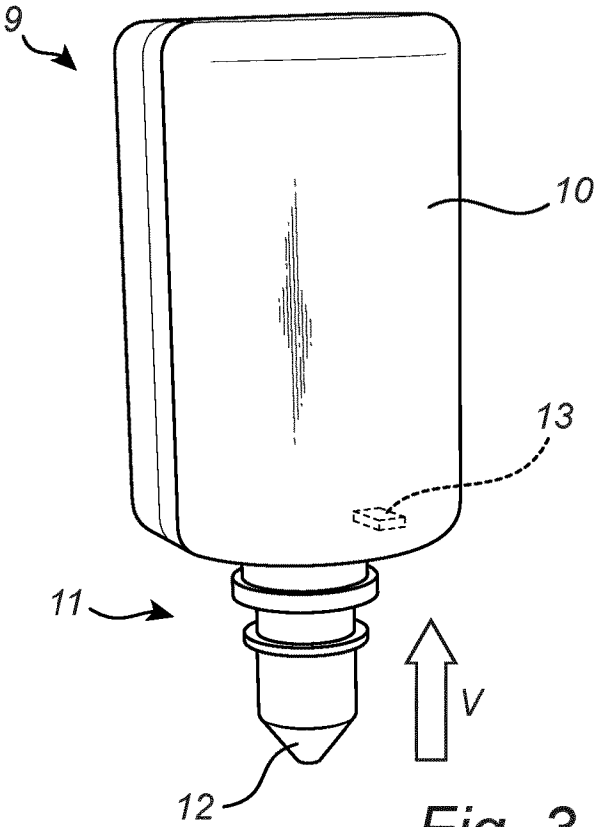
FIG. 3 shows a perspective view of a replaceable liquid container which is intended to be placed in the dispenser.

FIG. 3 shows a replaceable liquid container 9, also referred to as a "refill unit", which is intended to be used with the dispenser shown in FIGS. 1 and 2. The liquid container 9 is designed for storing and transporting liquid prior to use in the dispenser 1. The liquid container 9 is also designed to be inserted and fitted into the dispenser 1 for dispensing of the liquid. The liquid container 9 is designed to be used in dispensers of the type in which the dispensing takes place from the bottom of the dispenser. When then liquid container 9 is empty it may be removed and replaced with a new container.

As shown in FIG. 3, the liquid container 9 comprises a liquid reservoir 10 and a dispensing mechanism in the form of a pump unit 11 which is connected to and ends with a dispensing opening 12. The dispensing mechanism is actuated by means of the above-mentioned actuating device 7. The liquid reservoir 10 is the portion of the liquid container 8 in which liquid is stored. In FIG. 3, the liquid reservoir 10 is shown as having a generally cylindrical form, but other three-dimensional forms are also possible. The reservoir 10 is consequently hollow, and is made of a material which is suitable for the liquid contained therein, without degradation of the liquid or the liquid reservoir 10. Suitable materials for the liquid reservoir 10 are plastics, for example polyethylene or polypropylene.

Furthermore, the pump unit 11 acts to transfer liquid from the liquid reservoir 10 and dispense it. To this end, the liquid reservoir 10 is fluidly connected via the pump unit 11 to the dispensing opening 12 through which the liquid is discharged. A pump unit 11 for a liquid dispenser of the kind mentioned above is previously known as such from the patent document WO 2011/133085. For this reason, the pump unit 11 is not described in any greater detail here.

However, it should be mentioned that activation of the pump unit 11 by displacing its lower portion upwards, i.e. in a first generally vertical direction (arrow V), discharges a quantity of liquid from the liquid reservoir 10 via the dispensing opening 12. As illustrated in FIG. 3, the pump unit 11 is located at one end of the liquid reservoir 10, and the first direction (arrow V) is generally parallel or generally lies along a longitudinal axis of the cylindrical liquid reservoir 10.

As mentioned above, the disclosure is based on the fact that the liquid container 9 may contain, for example, a sanitizer, lotion, shampoo, skin care product, detergent, disinfectant, moisturizer, alcogel or a similar liquid, or alternatively fluids such as dispersions. Also, the contents of the liquid container can be discharged in many forms, suitably but not limited to foam, spray, gel, lotion or similar. Different types of contents in the liquid container and different methods of discharging said contents may require different types of pump units, which are adapted to the contents of the liquid container.

This means that the disclosure is not limited to dispenser systems with a pump unit as described with reference to FIG. 3 but can be implemented with other types of pump units. In fact, an example of an alternative type of dispensing mechanism unit is disclosed in the patent document WO 2017/050390.

Figure 4:
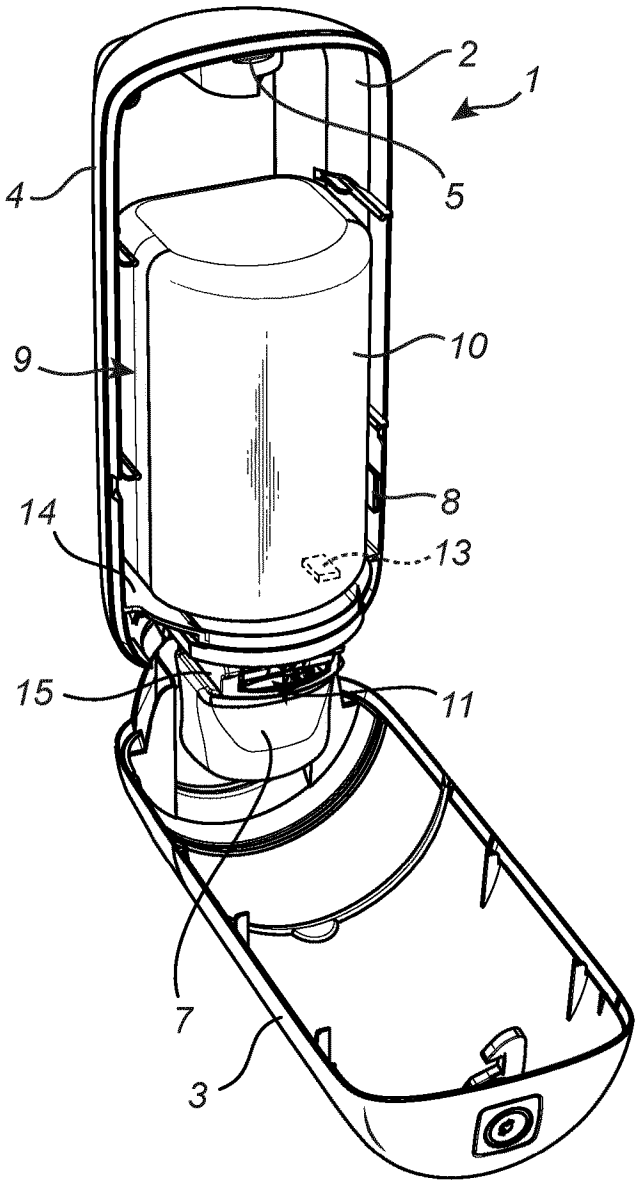
FIG. 4 shows a dispenser system with a dispenser, in a view corresponding to FIG. 2 but including a replaceable liquid container which is positioned in the dispenser.

FIG. 4 shows a dispenser system comprising the dispenser 1 and the liquid container 9, in an operating mode with the housing 2 in an open condition. When the first portion 3 is closed, the dispenser 1 is ready to be used. As shown, the dispenser 1 is provided with the replaceable liquid container 9, i.e. in a condition in which the container 9 is positioned inside the housing 2. In this condition, the liquid container 9 rests on a bottom surface 14 in the housing 2 and is arranged so that the pump unit 11 extends downwards through an opening 15 in said bottom surface 14. Also, the dispensing mechanism which according to one embodiment is in the form of a pump unit 11 is positioned behind the actuation device 7 so that it may be activated mechanically by means of the actuation device 7 when a user wishes to dispense soap. More precisely, and with further reference to FIGS. 5A and 5B, which show a side view of the replaceable liquid container 9 with the actuation device 7 shown in cross-section, it should be noted that the actuation device 7 is arranged in a pivotable manner with reference to a pivoting axis 16 arranged in the dispenser 1. Also, the actuation device 7 comprises an actuator surface 7*a*, which is configured so that a user may push on it, and a pump actuator 7*b*, which is configured so as be positioned below an annular flange 17 extending around the pump unit 11 when the actuation device 7 is in a stand-by condition.

Figure 5B:
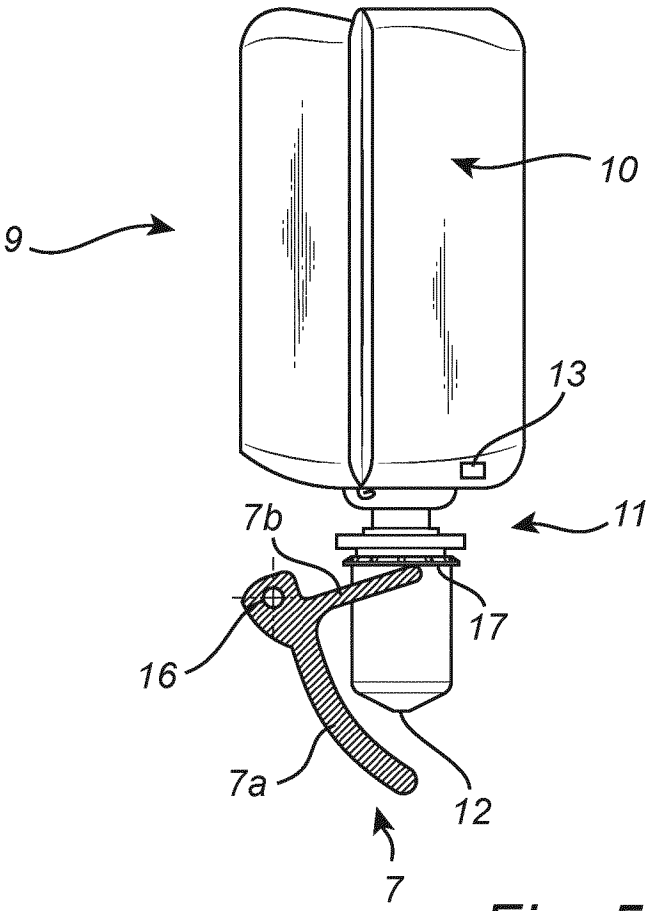
FIG. 5B shows a replaceable liquid container and the operation of an actuating unit, in a second condition.
Figure 5A:
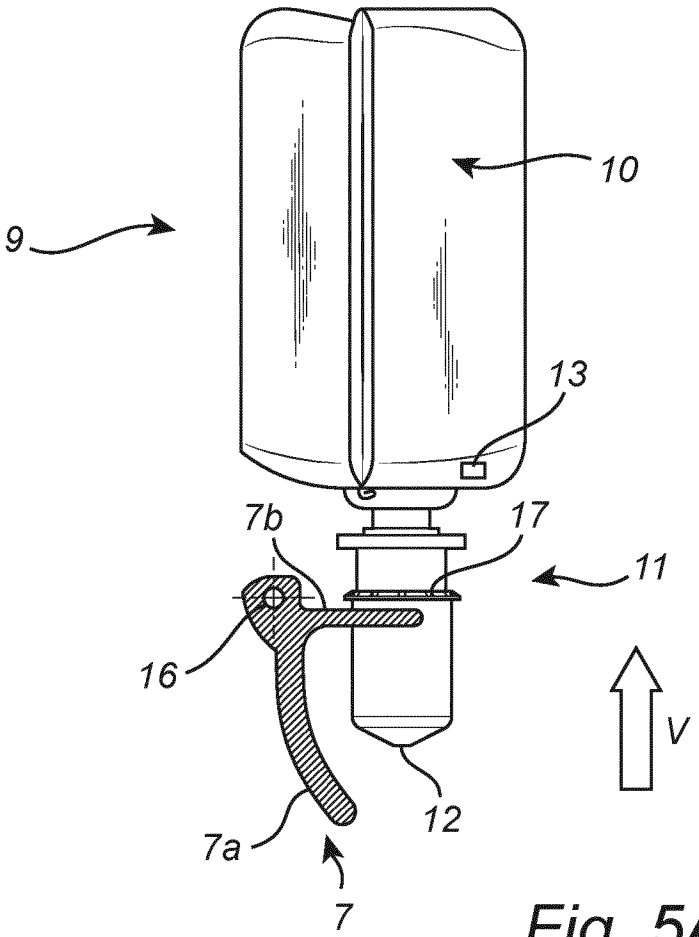
FIG. 5A shows a replaceable liquid container and the operation of an actuating unit, in a first condition.

In a first position, shown in FIG. 5A, the actuation device 7 is in a pivotal position in which it is accessible to a user. When the user pushes on the actuator surface 7*a* the actuation device 7 will pivot in a counter-clockwise direction. This rotation makes the pump actuator 7*b* move so as to force the flange 17 in an upwards direction (i.e. arrow V in FIG. 5) to thereby actuate the pump unit 11. In a second position, shown in FIG. 5B, the pump actuator 7*b* has reached a pivotal position in which the flange 17 has been forced to an upper position which corresponds to a condition in which contents of the liquid container have been pumped out via the dispensing opening 12.

It is previously known, for example through the above-mentioned document WO 2011/133085, how an actuation device as shown in for example FIGS. 5A and 5B can be operated to actuate a pump unit. In the context of the present disclosure, it should be noted that the pump unit 11 is configured with a displaceable element in the form of the flange 17. Upon actuation of the dispenser 1, the flange 17 is displaced with a generally linear motion along the longitudinal extension of the pump unit 11. This motion is detected by means of detection means, as will be described in greater detail below and with reference in particular to FIGS. 9, 10 and 11.

The replaceable liquid container 9 is arranged with means for storing unique identification data related to said liquid container 9. As indicated in FIGS. 3, 4, 5A and 5B, the liquid container 9 is provided with an electronic transponder 13 which can be pre-programmed with data indicating a unique data code which corresponds to the identity of each individual container 9. In one embodiment, the transponder 13 is suitably positioned on or close to a bottom outer surface of the liquid container 9 (see for example FIG. 4). Alternatively, the transponder 13 can be embedded within the material from which the liquid reservoir 10 is formed.

As discussed above, term "transponder" refers to an electronic device which is configured for receiving a signal and for emitting a response signal in response to the incoming signal. A particular type of known transponder which is suitable in the context of this disclosure is an RFID transponder, also referred to as an "RFID tag," which uses electromagnetic radiation to receive and process an incoming signal and to emit an outgoing signal. The RFID transponder is normally designed as a tag or a label comprising an antenna component which receives the incoming signal, and a processor component which processes the incoming signal and transmits the outgoing signal via the antenna component.

The RFID transponder can be programmed with data representing a unique identity. Accordingly, the RFID transponder 13 shown in the drawings is programmed with data indicating the identity of a corresponding liquid container 9 to which the RFID transponder 13 is attached. This means that already during manufacturing of each liquid container 9, its unique identity is stored on the attached RFID transponder 13.

The RFID transponder can be either passive (i.e. not requiring a built-in power source) or active (i.e. comprising a power source). Also, in addition to data representing the actual identity of a given liquid container, the RFID transponder 13 can be programmed with data representing for example the type of liquid stored in the liquid container 9 and the total amount of liquid stored in the liquid container 9. Also, the RFID transponder 13 may comprise data representing the date of manufacturing of the liquid container 9, or a suitable size of a soap dose which can be dispensed, or other types of data related to the liquid container and/or its contents.

According to other contemplated examples, the transponder can take other forms, such as an optically readable barcode or a tag or label based on for example Bluetooth® technology, for example.

Figure 6:
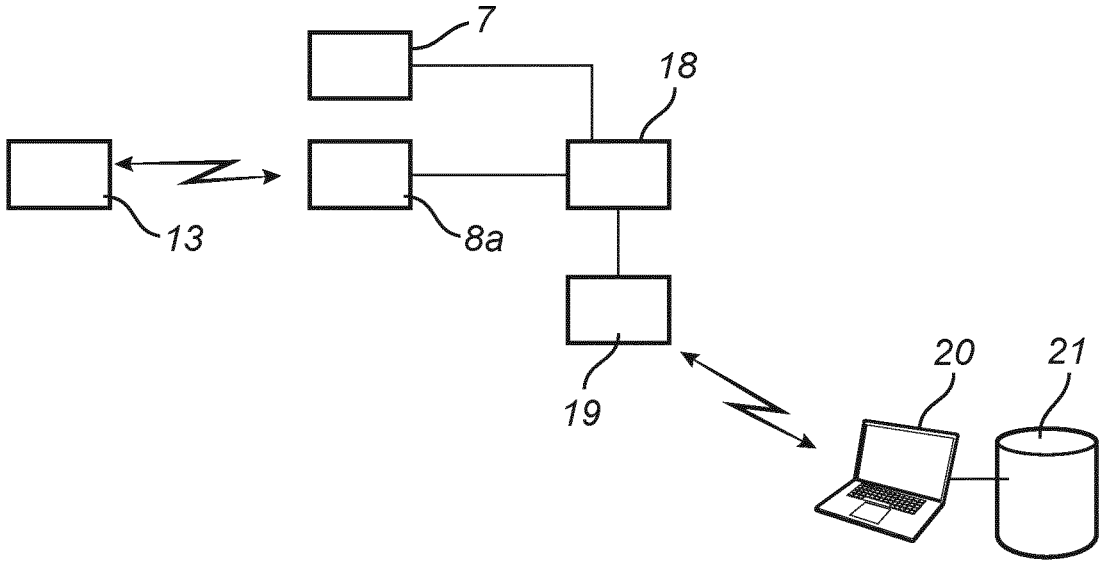
FIG. 6 is a schematic drawing of a system for detection of the consumption of the liquid container.

Furthermore, data associated with the transponder 13 can be detected and read by means of the transponder reader unit 8 which is shown in FIGS. 2 and 4. To this end, the transponder reader unit 8 is arranged for transmitting an interrogation signal to the transponder 13. Such an interrogation signal can for example be issued in order to request data from the transponder 13 representing the identity or type of liquid in the liquid container 9 with which that transponder 13 is associated. A response signal from the transponder 13 is then received and stored by means of the transponder reader unit 8. With reference to FIG. 6, there is shown in a simplified manner a schematic drawing of a system for transmitting data to and from the dispenser 1. The system is based on a microprocessor 18 which is connected to the transponder reader unit 8 and also to the actuation device 7. For this purpose, the actuation device 7 is provided with an electrical switch or detector (not shown) which is configured for generating an activation signal and transmitting said activation signal to the microprocessor 18 each time a user actuates the dispenser 1 by pushing on the actuation device 7.

An interrogation signal from the microprocessor 18 to the transponder 13 is suitably transmitted from the transponder reader unit 8 when a user pushes on the actuation device 7. The signal is transmitted to the transponder 13, which in turn generates a response signal including data which represents the actual identity of the transponder 13. This response signal is forwarded to the microprocessor 18. This can be carried out at a specific point in time or at a certain frequency, or when the actuation device 7 transmits an activation signal indicating that dispensing has been initiated.

The information which has been collected by the microprocessor 18 can subsequently be forwarded to a communications unit 19 which is configured for transmitting data to an external computer unit 20 which processes the incoming data.

According to an embodiment, the communications unit 19 comprises a radio transceiver which is arranged for providing two-way radio communication with the external computer unit 20. A computer memory unit 21 such as a database is suitably also connected to the external computer unit 20.

In one embodiment, the RFID transponder 13 only contains information regarding the unique identity of a liquid container 9. During an interrogation situation, data related to the identity of the liquid container 9 is transmitted to the external computer 20, which is arranged to fetch relevant data regarding the liquid container 9 and its contents from the database 21. Such relevant data may comprise information regarding the container's 9 identity and the accumulated amount of displacement of the pump unit 11. Based on such relevant data, information regarding for example a suitable time to replace the liquid container 9 can be forwarded to cleaning staff.

Consequently, the external computer unit 20 may send information to cleaning staff related to the liquid level of the liquid container 9, or alternatively whether a particular liquid container 9 has passed its "best before" or "use by" date, or whether a liquid container 9 needs to be replaced for example due to quality reasons.

In summary, the above-mentioned dispenser 1 is configured to house the replaceable liquid container 9, which is provided with a unique identity and which also carries a transponder unit 13 with stored identification data representing the identity of that particular liquid container 9. In a specific embodiment, the dispenser 1 comprises a transponder reader unit 8 that cooperates with the transponder unit 13 and which is also configured for communicating with an external computer unit 20. Also, the dispenser 1 is configured to detect the usage of the liquid container 9 so as to indicate whether the liquid container 9 needs to be replaced.

In one embodiment, the dispenser system is provided with a removable insert module 22 that accommodates a replaceable liquid container 9 during operation of the dispenser system. The term "insert module" is used to describe a unit which can be positioned inside the housing 2 in a releasable manner, i.e. temporarily or permanently. Consequently, the insert module 22 may or may not form part of the dispenser system. The insert module 22 is shown separately in FIG. 7 and is shown in a condition in which it is positioned inside the housing 2 of the dispenser 1 in FIG. 8. The general purpose of the insert module 22 is that it can be retrofitted into an existing dispenser in a simple manner in order to allow certain new functions to be implemented. In its most general form, the insert module is used for accommodating a replaceable liquid container. This means for example that the insert module can be arranged for use with a replaceable liquid container and be positioned inside an existing dispenser. In one embodiment, the insert module can also be used with a replaceable liquid container, having its own individual transponder unit, in a dispenser of such type which is not equipped with any transponder reader unit.

In one embodiment, insert module 22 supports and accommodates a replaceable liquid container 9 during operation of the dispenser 1. More precisely, the insert module 22 is first positioned in the housing 2, after which the liquid container 9 will be positioned so as to be supported by the insert module 22. In that regard, the insert module 22 in that example embodiment is designed with a base portion 23 which is generally U-shaped and used for supporting a liquid container 9, and a rear portion 24 which is positioned to be placed behind the replaceable liquid container 9 during use of the dispenser 1.

Furthermore, the insert module 22 is provided with a transponder reader unit 8*a* which is arranged for cooperating with a transponder unit 13 carried by the liquid container 9, in a similar manner as described above with reference to transponder reader unit 8 shown in FIGS. 2, 3 and 4. In the embodiment shown in FIG. 7, the transponder reader unit 8*a* is positioned in the rear portion 24 of the insert module 22.

Figure 7:
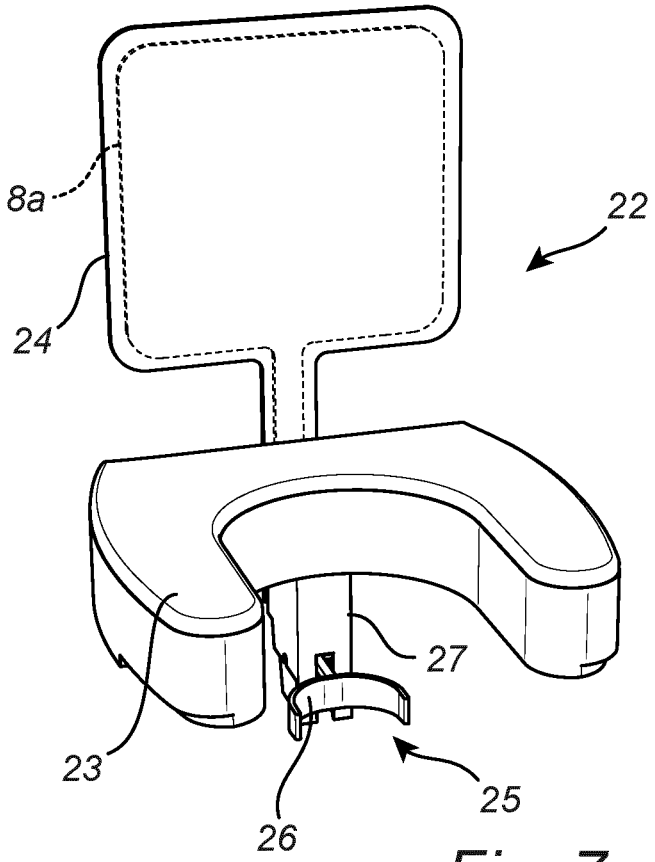
FIG. 7 shows an insert module in accordance with the disclosure.

This means that the insert module 22 can be used for a dispenser which is not provided with any transponder reader unit and where there is a need for detecting a transponder unit 13 on the liquid container 9. In other words, a dispenser 1 which has not been manufactured with any transponder reader unit can be retrofitted with an insert module 22 (suitably with the built-in transponder reader unit 8*a*) as shown in FIGS. 6 and 7. Such a dispenser 1 can then be used with a liquid container 9 having a transponder unit 13.

It should be noted that the dispenser 1 is configured to be operated either with or without the insert module 22. The first case is suitable if the dispenser 1 is not provided with any transponder reader unit. This can be relevant for example as regards older dispenser types which were not originally manufactured with the intention of being used with a liquid container having a transponder unit.

Furthermore, it should be noted that, in a specific embodiment, the insert module 22 may alternatively be arranged without any transponder reader unit. Such an insert module 22 may be suitable in those cases in which the dispenser 1 itself already has a transponder reader unit 8, as shown in FIG. 2.

Consequently, the dispenser as a whole comprises a transponder reader unit, either positioned in the housing or in the insert module (in case such an insert module is used).

This means that the dispenser 1 can be operated either with or without the insert module shown in FIG. 7.

The fact that the dispenser 1 comprises a transponder reader unit 8, 8*a* for detecting a transponder 13 should consequently be construed as meaning that either the insert module 22 or the dispenser 1 as such (i.e., suitably within the housing 2) is equipped with such a transponder reader unit 8, 8*a*.

Figure 8:
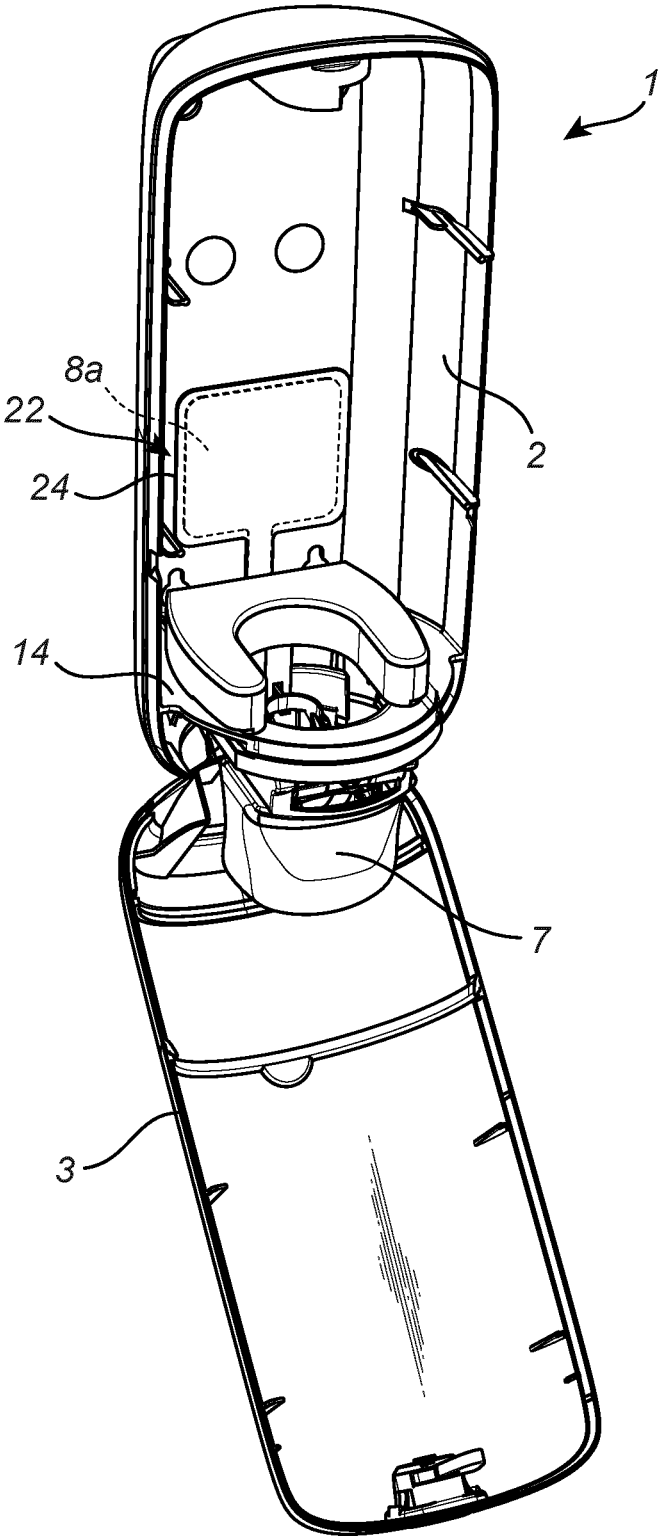
FIG. 8 shows a view of a dispenser and including the insert module of FIG. 7 which is mounted in the housing.

In the example embodiment shown in FIGS. 7 and 8, the insert module 22 is furthermore provided with a detection unit 25 which is arranged for detecting the cumulative consumption of the contents of the replaceable liquid container 9. This is suitably implemented by detecting the operation of the pump unit 11. More precisely, the detection unit 25 is based on a generally C-shaped actuator 26 which is pivotally arranged in a bottom portion 27 of the insert module 22 and which is configured to follow the movement of the flange 17 of the pump unit 11 shown in FIGS. 5A and 5B. This is obtained through the fact that the C-shaped actuator 26 is positioned around the circumference of the pump unit 11 and will be forced in a vertical direction through movement of the flange 17. As will be described in greater detail below with reference to FIG. 9, the C-shaped actuator 26 can be used for detecting usage of the pump 11 and to transmit data information regarding such usage to a microprocessor.

FIG. 8 shows the dispenser 1 with the insert module 22 mounted in the housing 2, i.e. so that the base portion 23 of the insert module 22 rests upon the bottom surface 14 of the housing 2 and so that the bottom portion 27 extends through the opening 15 in the bottom surface 14.

Figure 9:
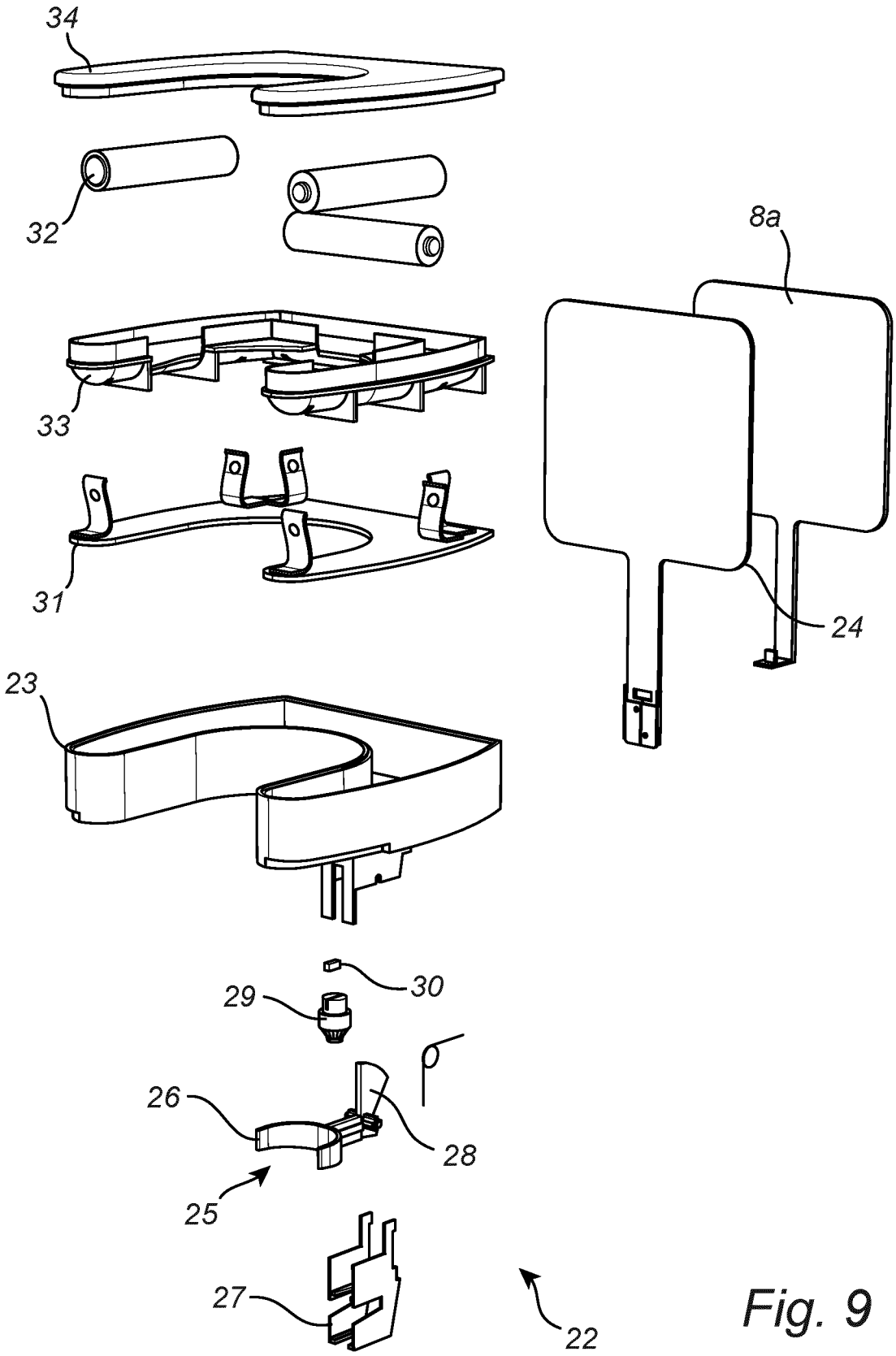
FIG. 9 shows the insert module from another angle, which in particular shows a detection device according to an embodiment.

FIG. 9 shows the insert module 22 in greater detail. As mentioned above, the insert module comprises a base portion 23 and a rear portion 24. The transponder reader unit 8*a* is integrated in the rear portion 24. Furthermore, the detection unit 25 is in the form of the generally C-shaped actuator 26 which is pivotally hinged in the bottom portion 27 which in turn is attached to the base portion 23.

In the embodiment of FIG. 9, the detection unit 25 has a gear portion 28 which meshes with a rotating gear element, which according to the embodiment is constituted by a gear wheel 29 which is arranged in the base portion 23 in a manner so that it may rotate about a generally vertical axis (with reference to the example orientation in the figures). Furthermore, any pivoting motion of the C-shaped actuator 26—which is caused by actuation of the pump unit 11—will act so that the gear portion 28 forces the gear wheel 29 to rotate in a direction which corresponds to the direction of pivotal movement of the actuator 26.

The gear wheel 29 is arranged so as to cooperate with a suitable sensor, for example a Hall sensor, which is a previously known type of magnetometer sensor based on a magnetic sensor which senses the presence of a magnetic field as generated by a permanent magnet, such as magnet 30 in the figures.

The actuating device 7 shown for example in FIG. 8 is displaced directly by a user by means of a pushing motion. Consequently, the actuating device 7 translates a displacement effected by the user into a movement of the detection unit 25 which corresponds to the displacement of the pump unit 11 and also the amount of liquid which has been dispensed. This means that the detection unit 25 can be used for measuring the actual cumulative amount of liquid which has been dispensed from the liquid container 9. Such information is suitably combined with information regarding the points in time at which dispensing has occurred, i.e. when a user has pushed on the actuating device 7.

The magnet sensor is not shown as such in FIG. 9 but is suitably arranged as a separate unit in the insert module 22, for example in a printed circuit board 31 which is positioned in the base portion 23. Furthermore, the insert module 22 comprises a compartment for a one or more batteries 32, which are enclosed by means of a lower section 33 and an upper section 34. The lower section 33 covers the printed circuit board 31.

Consequently, the magnetic sensor is positioned on the printed circuit board 31 which is enclosed within a waterproof compartment (defined by the base portion 23 and the lower section 33), whereas the magnet 30 is arranged outside that waterproof compartment.

In summary, the above-mentioned dispenser system comprises a dispenser 1 and a replaceable liquid container 9 and a dispensing mechanism which causes fluid to be selectively discharged from the liquid container 9 upon actuation. The dispensing mechanism comprises a pump unit 11 for discharging said liquid and the dispenser 1 comprises a detection unit 25 for detecting the displacement of the pump unit 11. Also, information related to the displacement can be transmitted to an external computer unit 20.

Furthermore, according to the embodiment described with reference for example to FIGS. 5A and 5B, the pump unit 11 comprises a displaceable element, suitably in the form of the flange 17 which, upon actuation, will be displaced with a linear motion during discharging of liquid, i.e. when the pump unit 11 is activated. Also, the flange 17 interacts with the rotating gear element 29, which is associated with a sensor of the magnetometer type.

Figure 10:
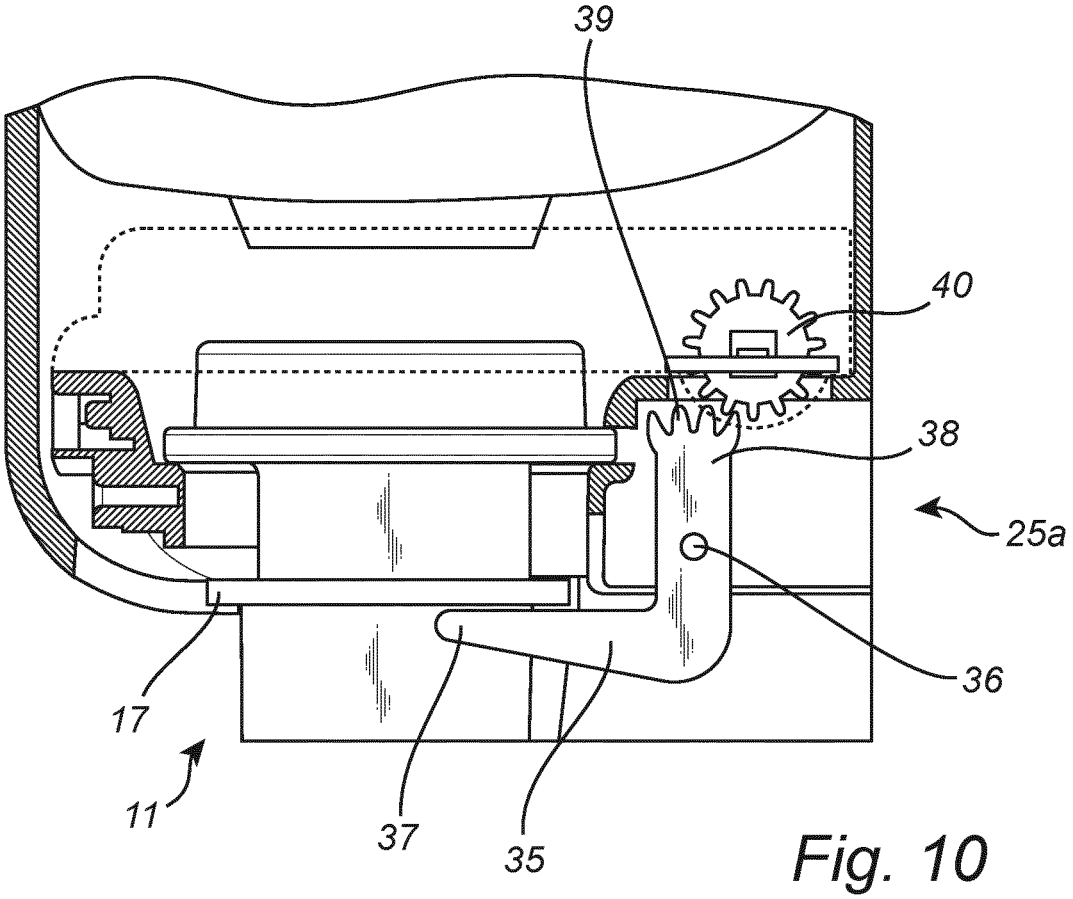
FIG. 10 shows a detection unit according to a further embodiment.

FIG. 10 shows an alternative embodiment of a detection device 25*a*, which comprises a generally L-shaped actuator 35 which is pivotally arranged to pivot about a pivot axis 36. In the event that the dispenser 1 is configured with an insert module 22 as described above, the pivot axis 36 is suitably arranged in said insert module 22. In the event that the dispenser 1 is not provided with any insert module, the pivot axis 36 is suitably arranged in the housing 2 of the dispenser 1.

The L-shaped actuator 35 is biased by means of a spring element (not shown) with an upwards directed force, i.e. so that a first edge portion 37 of the actuator 35 rests against the underside of the flange 17 of the pump unit 11. When a user activates the dispenser 1 and the pump unit 11, the flange 17 will be displaced with a generally linear motion as indicated with an arrow in FIG. 10. This means that the first edge portion 37 will follow the flange 17 upwards and the L-shaped actuator 35 will be pivoted in a clockwise direction.

The L-shaped actuator 35 has a second, oppositely disposed edge portion 38 which is formed with a geared section 39. The geared section 39 meshes with a gear wheel 40 which is arranged in the insert module (if this is used), alternatively in the housing 2 of the dispenser (if no insert module is used). The gear wheel 40 is associated with a magnetometer sensor which is configured to detect the rotational position of the gear wheel 40. This means also that a measurement of the movement of the pump unit 11, and consequently also the cumulative consumption of the dispenser 1, can be calculated.

Figure 11:
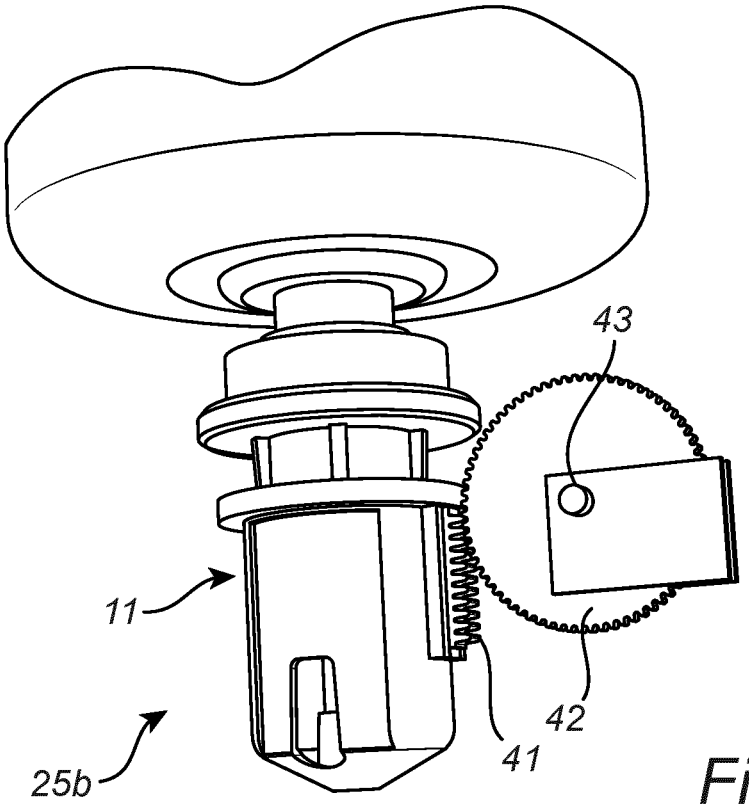
FIG. 11 shows a detection unit according to yet a further embodiment.

FIG. 11 shows a further embodiment of a detection unit 25*b*, which comprises a generally linear and straight geared section 41 which is disposed along the outer peripheral surface of the pump unit 11 and which follows the movement of the pump unit 11 (and the flange 17) during actuation thereof.

The geared section 41 is arranged so that it meshes with a rotating gear wheel 42 which is disposed so as to pivot about a further pivot axis 43. In the event that the dispenser 1 is configured with an insert module 22 as described above, this further pivot axis 43 is suitably arranged in said insert module 22. In the event that the dispenser 1 is not provided with any insert module, the pivot axis 43 is suitably arranged in the housing 2 of the dispenser 1.

The gear wheel 42 shown in FIG. 11 is associated with a magnetometer sensor which is arranged for detecting the rotational position of said gear wheel 42. This means also that a measurement of the movement of the pump unit 11, and consequently also the cumulative consumption of the liquid in dispenser 1, can be determined.

In summary, the embodiments in FIGS. 10 and 11 represent alternative solutions in which the pump unit 11 is provided with a sliding, displaceable element, i.e. the flange 17, which upon actuation has a generally linear motion and displacement during discharging of liquid from the liquid container 9. The flange 17 is in both cases connected to a rotating gear element which according to the embodiments is constituted by a gear wheel 40, 42 which is provided with and associated with a sensor of the magnetometer type. In the illustrative embodiments in those figures, the magnetometer sensor comprises a rotating magnet on the gear wheel 40, 42 which cooperates with a Hall effect sensor. In this manner, the rotational position of the gear wheel 40, 42 can be determined. Such measurements can be used for tracking and analyzing the cumulative consumption of liquid from the liquid container 9.

More precisely, and according to an embodiment, the sensor comprises a 2-dimensional or 3-dimensional Hall effect sensor that measures the orthogonal magnetic fields in the rotational plane of the magnet. When the magnet rotates during the actuation of the dispenser, the ratio of magnetic field strength among the measured dimensions changes and this ratio is used to determine the rotation angle of the magnet.

In another embodiment, not shown in the drawings, there is provided a detection unit which comprises a pair of Hall effect sensors which produces a voltage proportional to a magnetic field, and are configured such that when the dispenser is at rest, a magnet points more directly towards the first sensor of the pair and when the actuator is pressed, the magnet rotates to a point more directly towards the second sensor, which results in a shift of voltage from the first sensor to the second sensor. Such an embodiment gives a more precise process for measuring the angular position of the gear wheel in question.

Figure 12:
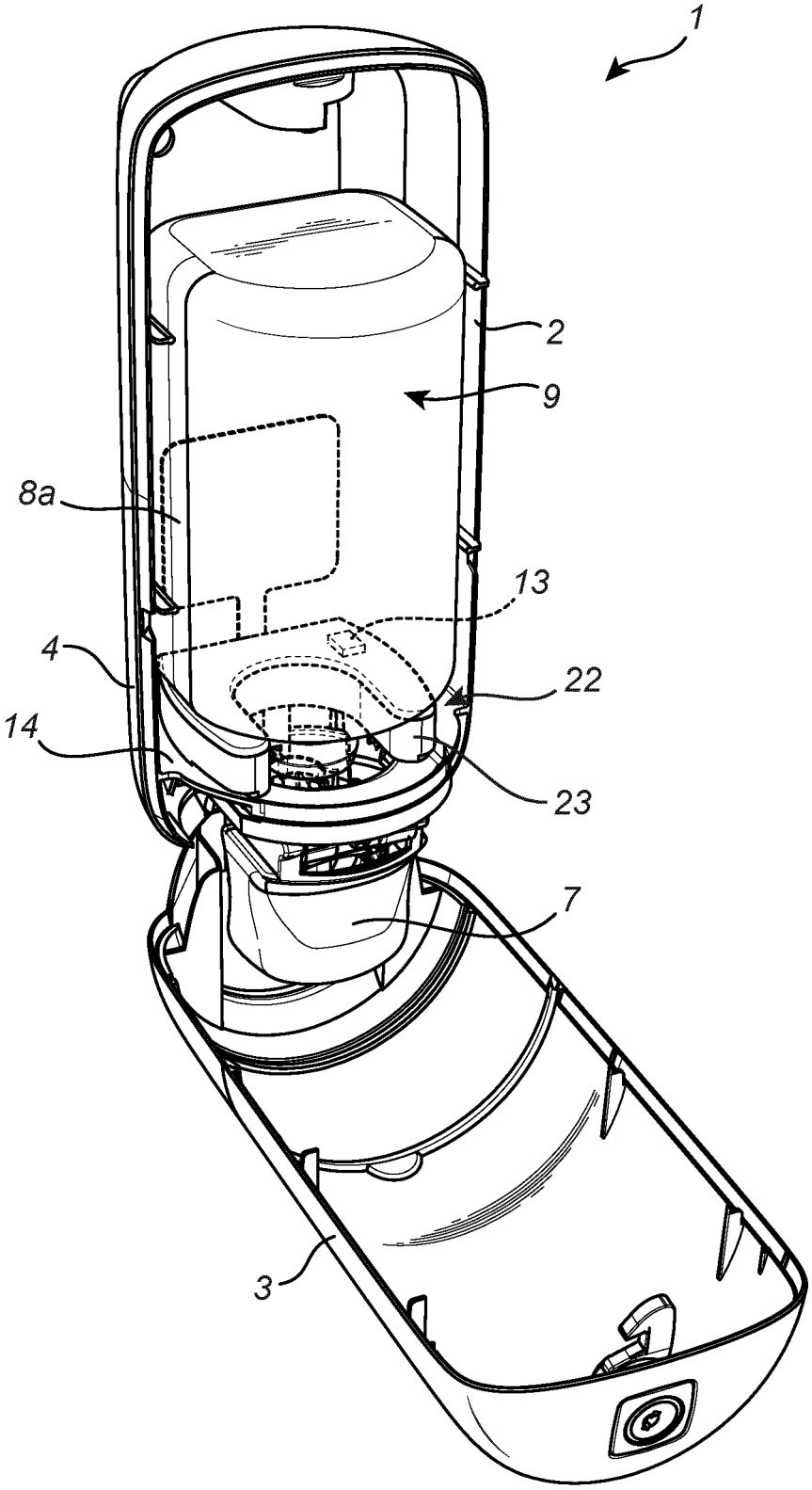
FIG. 12 shows a view corresponding to FIG. 8 with a dispenser system including a replaceable liquid container which is mounted in and supported by the insert module.

FIG. 12 shows a dispenser 1 in yet another embodiment in which the insert module 22 is positioned in the housing 2. Next, the replaceable container 9 is positioned in the insert module 22 in a manner so that the pump unit 11 extends through the U-shaped opening defined by the base portion 23. Also, the pump unit 11 is positioned so that the C-shaped actuator 26 of the detection unit 25 is positioned around a part of the circumference of the pump unit 11. This means that when a user pushes on the actuator 7, the pump unit 11 will be displaced as described with reference to FIGS. 5A and 5B, i.e. so that the flange 17 is forced upwards. This also means that the C-shaped actuator 26 is pivoted upwards. By means of the gear portion 28 of the actuator 26 which meshes with the gear wheel (see FIG. 9), detection of the movement of the pump unit 11 can be obtained.

Figure 13:
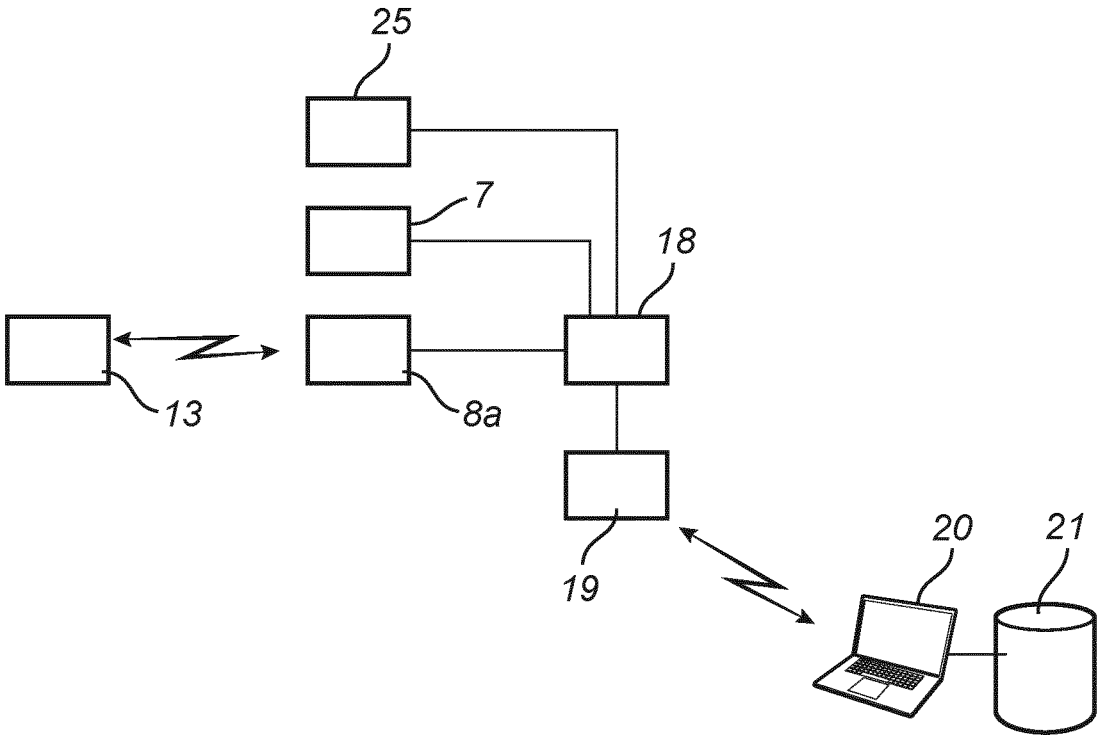
FIG. 13 is a schematic drawing of a system for detection of the consumption of the liquid container according to a further embodiment.

FIG. 13 shows a simplified schematic drawing of a system corresponding to the dispenser 1 according to FIGS. 7 and 8. More precisely, the system is based on the transponder unit 13 which can be detected by means of the transponder reader unit 8*a*, which is connected to a microprocessor 18. Also, the actuation device 7 is connected to the microprocessor 18 in generally the same manner as described with reference to FIG. 6, i.e. so that a signal is generated and transmitted to the microprocessor 18 when a user activates the dispenser 1.

Furthermore, the detection unit 25 is also connected to the microprocessor 18. In this manner, a signal corresponding to the usage, i.e. the cumulative dispensed amount of soap in the liquid container 9, can be generated when the actuation device 7 is activated by a number of users. Data regarding such usage can be transmitted to the microprocessor 18. This means that the cumulative amount of soap which has been dispensed can be calculated by means of the microprocessor 18. Data related to the usage of soap can furthermore be transmitted from the microprocessor 18 and to an external computer unit 20 via a communications unit 19.

By means of the system as described above, a number of processes for detecting and tracking usage of the dispenser 1 can be implemented. Firstly, the external computer unit 20 can be configured for calculating the cumulative usage of liquid in each liquid container 9 with which it communicates. This means that the external computer unit 20 can be configured for sending alert messages and instructions to maintenance staff when it has detected that a particular replaceable liquid container 9 is empty or close to empty.

The detection unit 25 is based on a magnetometer sensor which gives a highly accurate measurement of the movement of the actuator 26, which in turn gives an accurate measurement of the liquid used i.e. as in the embodiments of FIGS. 9, 10 and 11.

Furthermore, data from a large number of liquid containers can be used for collecting statistics regarding the use of the dispensers, for example for determining whether certain dispensers are used more frequently than others and for determining the overall consumption of liquid at a particular site, such as a hospital or airport. Also, the average use of liquid for each dispenser which is connected to the external computer unit 20 can be determined.

Also, information regarding the usage of liquid can be combined with other information which can be programmed on the transponder unit 13, for example which type of liquid is in the liquid container 9. This means that statistics regarding the usage of different types of liquids can be obtained.

Furthermore, the dispenser 1 can be configured for recognizing whether the liquid container 9 is of a particular brand, by checking (by means of the external computer unit 20 and the memory unit 21) whether the identity of the liquid container 9 is included in a pre-stored database of approved liquid containers.

Also, the dispenser can be configured for recognizing whether the liquid container 9 is a full, unused liquid container by checking, in the external computer unit 20, whether the identity of the liquid container corresponds to a unit which has not been used before.

Furthermore, the dispenser can be configured to display information related to the contents of an individual liquid container (e.g., type of fluid, volume) suitably on a display which is provided on the dispenser (not shown in the drawings).

Also, the information that is transmitted from the dispenser could comprise time stamp information, i.e. information on when a dispenser has been activated by a user. This means that information regarding when the liquid container needs to be replaced could be calculated both depending on cumulative usage data and also depending on the intensity of the user traffic associated with the dispenser.

The invention is not limited to the embodiment but can be varied within the scope of the appended claims.

Although the described embodiments relate to a liquid container 9 that contains soap, it should be noted that other liquids are contemplated, such as detergent, disinfectants, skin-care liquids, moisturizers, sanitizers, lotions, shampoo and other medicaments. The choice and composition of the liquid can be varied by the skilled person depending on the properties needed for the liquid and the desired result.

Also, the actuating device can be either of a manually operated or a motorized type. In the embodiment in FIG. 4, the actuating device is manually operated by a user.

In another embodiment, the actuating device can be motorized, which means that an electric motor is activated so as to operate the pump unit when a user pushes on the actuating device. Also, the actuating device can be automatic, i.e. based on a touch-free sensor, for example based on infrared technology, which senses the presence of a user and activates an electric motor when a user has been detected.

The invention claimed is:

1. A dispenser system comprising:

a dispenser and a replaceable liquid container; and a dispensing mechanism causing fluid to be discharged from the liquid container upon actuation and comprising a pump unit for discharging said liquid and a manual actuating device arranged for mechanically activating said pump unit upon actuation, wherein said dispenser further comprises a detection unit for detecting displacement of said pump unit, wherein information related to said displacement can be transmitted to an external computer unit, wherein the pump unit is configured with a displaceable element which, upon actuation, has a linear motion during discharging of liquid, wherein the displaceable element interacts with a rotating gear element, and wherein the gear element is associated with a magnetometer sensor.

2. The dispenser system according to claim 1, wherein the sensor comprises a rotating magnet on the gear element which cooperates with a fixed Hall effect sensor, in order to detect the rotational position of said gear element.

3. The dispenser system according to claim 1, wherein the detection unit comprises an actuator which is configured for being pivotally displaced through movement of said displaceable element, said actuator having a geared section which meshes with said gear element.

4. The dispenser system according to claim 1, wherein the displaceable element is configured for interacting with the gear element via a pivotally arranged and generally L-shaped actuator element having a geared section which meshes with said gear element.

5. The dispenser system according to claim 1, where the displaceable element is configured for interacting with the gear element via a generally linear geared section which is arranged on the pump unit and which meshes with said gear element.

6. The dispenser system according to claim 1, wherein the sensor comprises a 2-dimensional or 3-dimensional Hall effect sensor that measures the orthogonal magnetic fields in the rotational plane of said magnet, said sensor being configured so that when the magnet rotates during the actuation of the dispenser, the ratio of magnetic field strength among the measured dimensions changes and is used to determine the rotation angle of the magnet.

7. The dispenser system according to claim 1, wherein the dispenser comprises an insert module which is configured to be removably positioned in said dispenser, said insert module being configured for accommodating said liquid container.

8. The dispenser system according to claim 7, wherein the detection unit is arranged in said insert module.

9. The dispenser system according to claim 1, wherein the dispenser comprises a transponder reader unit for cooperating with a transponder unit supported by said replaceable liquid container.

10. The dispenser system according to claim 9, wherein said transponder unit is an RFID tag and the transponder reader unit is an RFID reader unit.

11. The dispenser system according to claim 1, wherein the rotating gear element is constituted by a gear wheel.

12. The dispenser system according to claim 1, wherein the actuation device is configured in a pivotable manner with reference to a pivoting axis arranged in the dispenser and comprises an actuator surface which is configured so that a user may push on it, and a pump actuator which is configured so as to be positioned below an annular flange extending around the pump unit when said actuation device is in a stand-by condition.

13. A method for operating a dispenser system comprising a dispenser and a replaceable liquid container, said method comprising:

providing a pump unit for discharging liquid from the liquid container upon actuation of said dispenser system;

mechanically activating said pump unit by means of a manual actuating device;

detecting a displacement of said pump unit upon actuation;

transmitting information related to said displacement to an external computer unit;

detecting a linear motion during discharging of liquid, upon actuation, of a displaceable element forming part of said pump unit;

providing interaction of the displaceable element and a rotating gear element; and arranging the gear element so as to be associated with a magnetometer sensor.

14. The method according to claim 13, wherein said method furthermore comprises:

detecting a rotational position of said gear element by means of a rotating magnet forming part of the sensor and provided on the gear element and cooperating with a fixed Hall effect sensor.

15. The method according to claim 13, wherein said method furthermore comprises:

pivotally displacing an actuator forming part of the detection unit, through movement of said displaceable element, said actuator having a geared section which meshes with said gear wheel.

16. The method according to claim 13, wherein said method furthermore comprises:

allowing interaction of the displaceable element and the gear element via a generally linear geared section which is arranged on the pump unit and which meshes with said gear element.

17. The method according to claim 13, wherein said method furthermore comprises:

providing cooperation between a transponder reader unit and a transponder unit supported by said replaceable liquid container.

* * * * *